United States Patent [19]

Blake et al.

[11] Patent Number: 4,579,226

[45] Date of Patent: Apr. 1, 1986

[54] LUMINAIRE SHIPPING CARTON ASSEMBLY

[75] Inventors: Walter R. Blake; Omer E. Murray, both of Hendersonville, N.C.

[73] Assignee: General Electric Company, Hendersonville, N.C.

[21] Appl. No.: 676,374

[22] Filed: Nov. 29, 1984

[51] Int. Cl.[4] ..... B65D 85/42

[52] U.S. Cl. ..... 206/422; 206/586; 206/593

[58] Field of Search ..... 206/422, 585, 586, 587, 206/588, 592, 593

[56] References Cited

U.S. PATENT DOCUMENTS

| | | | |
|---|---|---|---|
| 1,725,291 | 8/1929 | Moore | 206/422 |
| 2,097,757 | 11/1937 | Deike | 206/422 |
| 3,028,954 | 4/1962 | Forrer | 206/422 |
| 3,822,785 | 7/1974 | Getz et al. | 206/422 |
| 4,294,359 | 10/1981 | Berkel | 206/422 |

*Primary Examiner*—Joseph Man-Fu Moy
*Attorney, Agent, or Firm*—Henry J. Policinski

[57] ABSTRACT

A carton for packaging a clamshell type luminaire comprising a paperboard box of a height accommodating the luminaire lengthwise and having a square cross-section in which the luminaire with refractor dismounted is accommodated diagonally. A diagonal locking panel filler has a face portion pressing against the rear portion of the humped bottom side of the luminaire to wedge its top side into a corner of the carton. The face portion has attached wings or side panels erected to form a right angle corner support conforming to the interior of the carton and transmitting to the carton walls the load created by the weight of the luminaire.

7 Claims, 4 Drawing Figures

35 1/2"

17 1/4"

D

LUMINAIRE SHIPPING CARTON ASSEMBLY

The invention relates to paperboard cartons for packaging clamshell or cobra-head-shaped luminaires for shipping purposes and for storage.

BACKGROUND OF THE INVENTION

Roadway type luminaires commonly used for the lighting of streets and highways generally have a curved rounded back or top side and a medially humped bottom side with a refractor supported in its front portion. The bottom side is usually arranged to swing or pivot open to give access to the optics or to the electrical components, whence the name clamshell. The luminaire is usually mounted through a rear slipfitter on a pipe standard projecting upwardly from a lighting pole; as seen from below it bears some resemblance to a cobra with head raised, whence the alternative name.

Roadway luminaires must be packaged for shipping from factory, to warehouse, to service shop, to job site, and shipping is generally by truck in which space is at a premium. The refractor is of glass or clear plastic and, on account of its fragility, must be dismounted from the housing and protectively wrapped. Up to the present, what has generally been used is a wide corrugated paperboard carton in which the luminaire is supported bottom side against a broad side of the carton. Fillers are used as wedges to hold the luminaire housing in place and the refractor is included in the same carton and protected by an elaborate glass wrap filler.

SUMMARY OF THE INVENTION

The object of the invention is to provide a shipping carton or package for a clamshell or cobra-head-shaped luminaire which will provide the maximum amount of protection in the minimum amount of space while requiring the least amount of filler and labor to package the contents.

In accordance with our invention we support the luminaire with its bottom side diagonally oriented in a paperboard carton and thus reduce the carton to the least size that will accommodate the unit. The rounded top side of the luminaire is wedged into a corner of the carton so that the adjacent sides of the carton are contacted by the curved surfaces of the luminaire housing which are the strongest and least subject to damage.

In a preferred embodiment, the carton is a corrugated paperboard box of a height or length accommodating the luminaire lengthwise together with end filler pads, and having a square cross-section in which the luminaire is accommodated diagonally. A diagonal locking panel filler is inserted into the carton and its face portion presses against the rear portion of the humped bottom side of the luminaire housing to wedge the luminaire into a corner of the carton. The locking panel filler preferably is of double corrugated stock with the corrugations running transversely to the long dimension of the box. The face portion has wings or side panels erected to form a right angle corner support conforming to the interior of the carton. The locking panel filler transmits load to the walls of the carton, and at the same time partitions off a protected corner space in which the refractor is safely accommodated.

DETAILED DESCRIPTION

Figures 1, 2, 3:
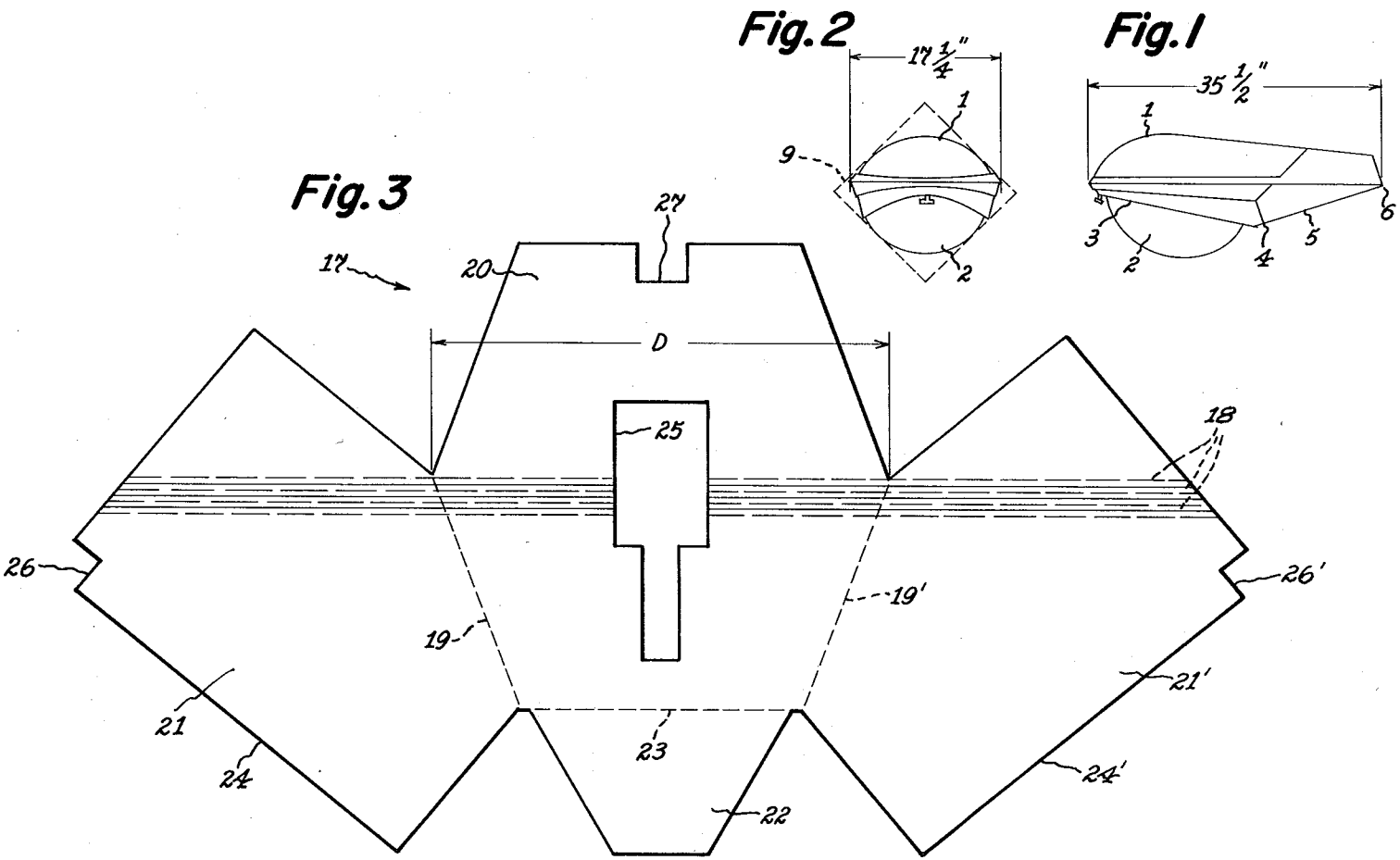
FIGS. 1 and 2 are side and end outline views of a roadway luminaire shown to a smaller scale than the other figures.
FIG. 3 shows the locking panel filler spread out flat.

Referring to FIGS. 1 and 2, there is shown a typical clamshell or cobra-head-shaped luminaire of a type commonly used for street and highway lighting. It comprises a curved die cast aluminum housing 1 forming a rounded back or top side, and aluminum panels forming a medially humped bottom side of which the front portion supports a bowl-shaped refractor 2. In the illustrated luminaire, the bottom side comprises two pivoting portions, the front portion 3 which forms a frame for the refractor and is hinged at 4, and the rear portion 5 which is hinged at 6. The rear portion forms a power module panel on the inside of which the ballast assembly is mounted for ease of installation and changeout.

Figure 4:
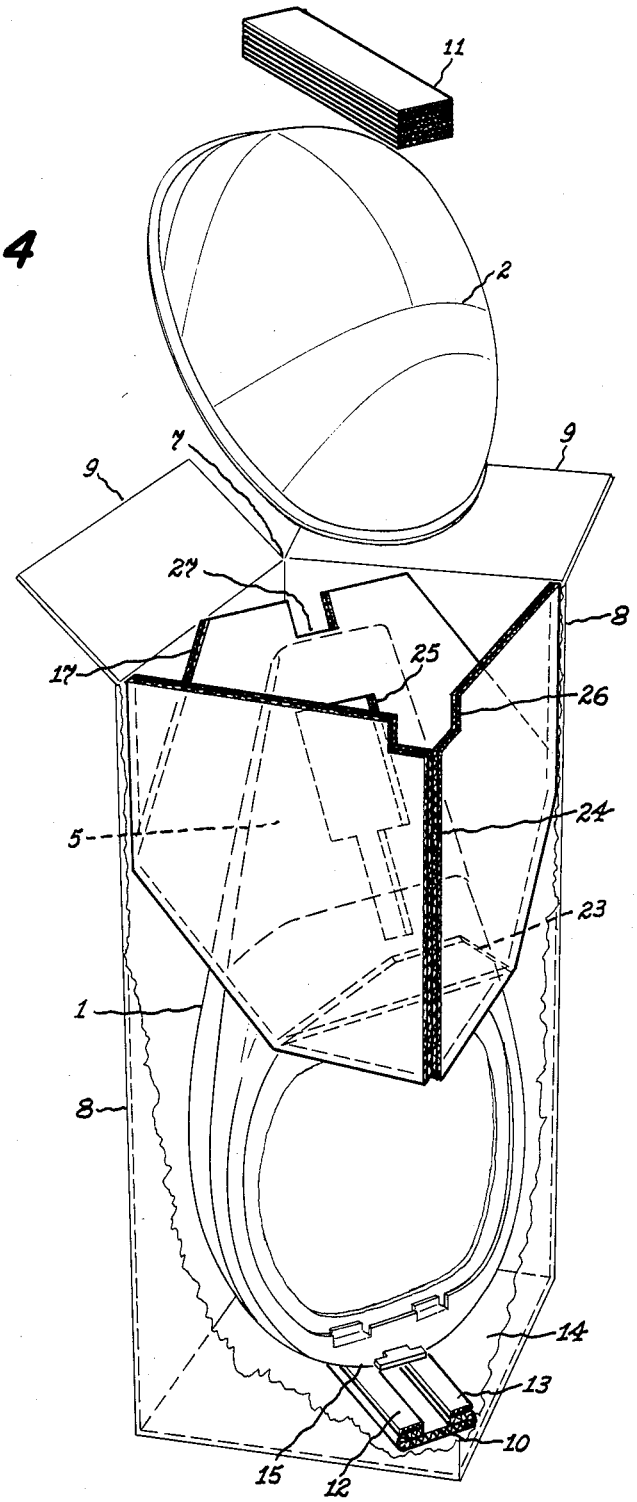
FIG. 4 is a pictorial exploded view of the luminaire and carton assembly with portions of the carton cut away.

In the carton and package assembly embodying the invention illustrated in FIG. 4, the rounded back of the housing 2 is nested in the rear vertical corner 7 of paperboard box 8. The size of the box in relation to the luminaire is suggested by the dotted outline in FIG. 2. The box is of conventional construction with end flaps 9 meeting in the center. It is made of single wall corrugated fibreboard, also known as double face, being the structure formed by one corrugated inner member glued between two flat facings. The box is square in transverse horizontal section and has a height or length accommodating the luminaire lengthwise, together with a bottom filler pad 10 and a top filler 11. The bottom filler pad consists of a piece of corrugated fibreboard with several thicknesses 12, 13 folded flat and piled up along opposite edges leaving a channelway in between. It is stapled to the bottom 14 of the carton and forms a crushable cushion against which the blunt nose 15 of the luminaire presses.

The diagonal locking panel filler 17 is shown spread out flat in FIG. 3. It is of double wall corrugated stock, that is the structure formed by three flat facings and two intermediate corrugated members; the corrugations 18 extend from edge fold 19 to edge fold 19' in the central portion 20 and through the wings 21, 21'. The central portion is proportioned such that the widest dimension indicated "D" corresponds to the diagonal from corner to corner inside the carton. The wings 21, 21' extend fan-wise from the central portion 20 on opposite sides and are scored or creased at 19, 19' where they attach to it. Likewise, skirt portion 22 extends from the lower side of the central portion and is scored at 23. The locking panel is erected by first folding up skirt portion 22, then folding back together wings 21, 21' so that they meet along edges 24, 24' and form a right angle. The edges 24, 24' may be paper-taped together to facilitate inserting the locking panel into the carton.

The locking panel filler 17 is inserted into the carton as shown in FIG. 4 and its central portion engages and presses against rear portion 5 of the luminaire's bottom side. The locking panel filler is what wedges the luminaire into the corner of the box and transmits load to the edges where the box is strongest. In view of the load which it must accept, the panel is made of double corrugated paperboard stock with the corrugations crosswise to the length of the box. The panel will flex to compensate for minor dimensional variations and also to absorb shocks resulting from freighting and handling of the carton.

The keyhole-shaped cut-out 25 in the middle of central portion 20 of the locking panel filler is provided to accommodate protrusions such as a latch in the bottom side of the luminaire. The locking panel filler when inserted in place as shown in FIG. 4 partitions off a corner space in which the relatively fragile glass or plastic refractor 2 is safely accommodated. The L-shaped cut-outs 26, 26' in the outer corners of the wings 21, 21' and the notched cut-out 27 in central portion 20 accommodates the top filler 11 in the top of the carton. Top filler 11 consists of multiple thicknesses of corrugated paperboard and provides a crushable pad against which the slipfitter end of the luminaire can rest. It also serves to confine the dismounted refractor in its corner space and prevents it from moving about.

The described shipping carton passes standard drop tests on all six sides and the usual vibration tests so that it meets freight carriers' specifications.

The economy and practical advantages of our shipping carton will be more fully appreciated from a comparison with the shipping carton formerly used by the assignee of this invention to ship its M-400 line of roadway luminaires. These luminaires can be fitted to operate 400-watt mercury, metal halide or high pressure sodium vapor lamps and have the configuration and dimensions indicated in FIGS. 1 and 2. They are widely used for street and highway lighting throughout the United States.

The wide corrugated carton formerly used measured $19\frac{7}{8}'' \times 12\frac{7}{8}'' \times 38''$ H, occupied 5.6 cu. ft. of shipping space, and utilized 28.2 sq. ft. of 200 lb. test single wall corrugated paperboard. It required 3 die cut fillers of 275 lb. test double wall corrugated stock, one in which to wrap the refractor, and one for each end of the luminaire.

By contrast, our new shipping carton used to package the M-400 line of roadway luminaires measures $14'' \times 14'' \times 37''$ H, occupies only 4.2 cu. ft. of shipping space and utilizes only 20.0 sq. ft. of 200 lb. test single wall corrugated paperboard. It requires three fillers but only one, namely the locking panel filler, is a die cut. It will be appreciated that a die cut filler requires a special die to cut it, which increases its cost greatly by comparison with slit cut fillers which do not require any special die. Also in shipping low density freight such as luminaires by highway trailer truck, cost is closely tied to shipping space and our new carton provides a 25% reduction in shipping volume which is translated quasi-proportionally into reduced shipping cost.

While the invention has been described with reference to a particular embodiment thereof, it will be understood that various modifications may be made by those skilled in the art to adapt to variations in luminaire shape or configuration. The appended claims are intended to cover all such equivalent variations coming within the scope or spirit of the invention.

What I claim as new and desire to secure by Letters Patent of the United States is:

1. A shipping carton for a luminaire of the clamshell type having a top side and a medially humped bottom side together with a bowl-shaped refractor which in use is mounted in the front portion of the bottom side, said top side extending from a blunt nose to a tapered slipfitter end, comprising:

a paperboard box having a substantially square horizontal cross-section, as seen standing up, in which the luminaire with the refractor dismounted can be snugly accommodated lengthwise in a diagonal orientation, said box having a height exceeding the luminaire's length, and a diagonal one-piece locking panel filler having a face portion fitting within the box as a diagonally oriented slanting partition said face portion engaging opposed corners of said square cross-section of said box, said panel filler comprising a pair of wing portions each having an edge extending beyond score lines on the two opposite sides of said face portion separated by the lowermost side, said wing portions being folded toward each other at the score lines to meet along said edges and form a right angle corner support fitting within one corner of the box and holding the face portion in place as a slanting partition pressing against the rear portion of the luminaire's bottom side and wedging the luminaire into the opposite corner of the box, said panel filler comprised of corrugated paper board stock with the corrugations thereof in said face portion extending in a direction along the diagonal between opposed corners of said square cross-section of said box.

2. A shipping carton as in claim 1 wherein the panel filler serves also to partition off an end corner of said box into a compartment in which the dismounted refractor may be accommodated.

3. A shipping carton as in claim 1 wherein the face portion of said panel filler is six-sided and has a maximum transverse dimension corresponding to the inside diagonal dimension of the box in a horizontal plane.

4. A shipping carton as in claim 3 wherein the six-sided face portion of said panel filler has a skirt portion extending from its lower side, said skirt portion being folded up between the wing portions to provide a bottom wall for a compartment partitioned off by said panel filler.

5. A shipping carton as in claim 1 wherein the box has a height accommodating the luminaire lengthwise together with bottom and top fillers, a bottom pad filler in said box cushioning the nose of the luminaire, and a top pad filler cushioning the slipfitter end of the luminaire.

6. A shipping carton as in claim 1 wherein said box is made of single wall corrugated fibreboard and said panel filler is made of double wall corrugated fibreboard with the corrugations extending crosswise to the length of the box.

7. A shipping carton as in claim 4 containing a luminaire of the clamshell type, said luminaire being cushioned within the box by said bottom and top fillers and wedged into one corner by said panel filter, and the dismounted refractor of the luminaire being stored in the compartment partitioned off by said panel filler.

* * * * *